US005409121A

United States Patent [19]

Charette

[11] Patent Number: 5,409,121

[45] Date of Patent: Apr. 25, 1995

[54] AUTO-GRIP CLOTHES HOLDING ELEMENTS

[76] Inventor: Raymond Charette, 610 St-Odile, Rimouski (Québec) G5L-1G7, Canada

[21] Appl. No.: 149,563

[22] Filed: Dec. 28, 1993

[51] Int. Cl.[6] ..... A47F 5/00

[52] U.S. Cl. ..... 211/119.13

[58] Field of Search ..... 211/119.01, 119.13, 211/119.14, 119.15

[56] References Cited

U.S. PATENT DOCUMENTS

| | | | |
|---|---|---|---|
| 2,407,387 | 9/1946 | Seymour | 211/119.01 |
| 2,654,134 | 10/1953 | Sauerman | 211/119.13 X |
| 2,676,711 | 4/1954 | Jardim | 211/119.02 |
| 2,815,864 | 12/1957 | Alexander | 211/119.02 |
| 3,656,630 | 4/1972 | Miguel | 211/119.02 |
| 4,189,055 | 2/1980 | Nohzuka | 211/119.13 X |
| 4,519,509 | 5/1985 | Doyle | 211/119.13 |

FOREIGN PATENT DOCUMENTS

| | | | |
|---|---|---|---|
| 832296 | 1/1970 | Canada | 211/119.13 |
| 197808 | 8/1978 | France | 24/532 |

*Primary Examiner*—Robert W. Gibson, Jr.

[57] ABSTRACT

For use with a conventional clothes line assembly provided with means for slackening the line, a set of pairs of clothes holding elements secured to the line in spaced relationship therealong and placed in opposition one with the other, the use in opposition of two elements allowing the gripping of clothes, and comprising a pair of elongated bodies each made of a rigid material, each body generally oriented coaxially with respect to the line and comprising a trailing end coaxial to the line and a gripping end with an extention tip projecting perpendicularly to the trailing end, the gripping ends of the two bodies facing each other, each tip forming an angle relatively perpendicular to the clothes line and varying from 80 to 90 degrees so that when the two elongated bodies are coaxial the two extention tips face each other, the two opposing gripping faces grip the clothing, the same arrangement allowing ungripping when the two bodies get on the pulley, thus becoming no longer coaxial with the straight portion of the line and the gripping faces separate, releasing any clothing gripped between the gripping faces.

5 Claims, 6 Drawing Sheets

AUTO-GRIP CLOTHES HOLDING ELEMENTS

FIELD OF THE INVENTION

The invention relates to clothes-lines and, more particulary, to means for securing garments on the clothes line.

BACKGROUND OF THE INVENTION

In conventional clothes lines assemblies, it has always been bothersome to secure each garment onto the clothes line with clothes pins. The clothes must be hung on the lines and then secured manually with clothes pins, moreover these clothes pins must also be removed manually and stored away when the dry garments are taken in. Many inventions have tried to remedy these inconveniences:

U.S. Pat. No. 2,407,387 Seymour, Sep. 10, 1946, shows a unwinding/winding apparatus designed to allow clothing to be inserted into the weaves of three ropes specially braided together. Though this combination removes the need for clothes pins, it is however quite complex for a task that, in itself, is not complicated. Moreover the presented embodiment—FIG. 1—requires that the user moves the apparatus, by handle 8, along the line.

U.S. Pat. No. 2,676,711 Jardim, Apr. 07, 1954, illustrates a self-pinning clothes line that features a standard line wrapped with a cover featuring openings 11—FIG. 1—that allow the pinning of clothes caught between the cover and the line without any clothes pins. However the pinning action requires some pulling of the wrapping cover by the user, unlike Seymour's, which performs the pinning automatically.

U.S. Pat. No. 2,815,864 Alexander, Dec. 10, 1957, shows a clothes line fitted with permanently attached clothes pins, which are normally closed but are opened when passing over a prying element located around a section of the pulley, on the side of the user. This system regroups the abilities of both previous patents, that is clothes pins incorporated to the line and a system for opening them with no actions other than the moving of the line. However the apparatus needs the addition of a new pulley, which would prove relatively costly and bothersome to install. Also, any misalignment of the pins will cause the system to block or to fail to open a pin that would have passed beside the prying element.

U.S. Pat. No. 3,656,630 Miguel, Apr. 18, 1972, illustrates an "endless" clothes line with a triple pulley and clothespins and a mechanism for the automatic pinning and releasing of the clothes. However to do this it necessitates three pulleys on the user's side, a retaining frame assembly and a long clothes line. All of this renders the system relatively costly to implement and prone to malfunction.

U.S. Pat. No. 4,519,509 Doyle, May 28, 1985, shows a double pulley arrangement also embodying a predisposed set of pins such as Miguel's and necessitating an auxiliary line.

CAN 832296 Lund (Laird) Jan. 20, 1970, illustrates a clothes clip integrated in a clothes line; though quite simple and practical it provides no means for automatic opening and closure of the clothes pins. The disavantages of the system are that the clothes line has to be cut in order to insert the assembly and that the surfaces of the assembly has few teeth to trap the clothes in place on the line; the method can damage articles when the assembly is clamped shut or opened. It also needs a greater force to pull apart and release the clothes in the assembly.

OBJECTIVES OF THE INVENTION

It is therefore the prime objective of this invention to provide a simple and economical plurality of clothes holding elements secured to a clothes line in spaced relationship therealong, for use with a conventional clothes line assembly.

It is also a most important objective of this invention to provide clothes holding elements, their use in pairs with one element acting in opposition with the other, allowing for the gripping of clothes.

Another objective of this invention is to provide means for attaching the elements to the clothes line.

It is yet another objective of this invention to provide the clothes holding elements with a body made of a rigid material and being able to fit in the groove of a standard clothes line pulley, the body comprising a trailing end coaxial to the line and a gripping end projecting laterally of the body and comprising a face plane perpendicular to the direction of the line, the tip of which forms an angle, so that when two elements face each other the two opposing face planes grip the clothing.

Another important aspect of the invention is to provide attachment means comprising a top retaining surface with a downwardly oriented first retaining lip, said top retaining surface disposed in a bridge manner between two upwardly oriented second retaining lips one at each end of body such as to allow only the passage of a slightly bent clothes line between the two sets of opposing lips. More precisely, attaching means comprise:

the combination of the trailing and gripping ends forming between each other a straight horizontal line, each clothe holding being aligned horizontally under the clothes line, and a downwardly oriented upper lip mounted on the side of the element, the downwardly oriented upper lip comprising an inside surface projecting perpendicularly with respect to the horizontal straight line up to a position beyond the horizontal straight line, the inside surface defining a through channel through which the clothes line is inserted, the rigid body being secured to the line by a wedging element formed by the inside surface and driven downwardly against and beyond horizontal straight line therefore blocking trailing and gripping ends against clothes line thus preventing movement therefrom.

Further aspects of the invention will appear as the description proceeds.

SUMMARY OF THE INVENTION

The clothes line assembly proposed in the invention is composed of an ordinary clothes line, the pulley of which is located on the user's side and is fitted with a single U-shaped carriage instead of a carriage with two "U"'s at about 90°. The clothes holding elements are formed of a pair of identical elongated bodies, made out of metal or resilient polymer, with downwardly projecting extensions opposing each other. When the two elements are aligned coaxially on a straight portion of the line, the two extensions are pushed towards each other thus gripping any piece of clothes put between them. When they pass on the pulley, the two elements find themselves at an angle, due to the curve of the pulley, thus opening the two extensions of face planes.

To install the element one has simply to bend the line just enough so that it passes through the space between the lips located on one of the sides of the element; when the line straightens, it takes its place in the smaller channel formed by the lips, the top and side portion of the elongated body blocking the line within the element. One can put as many elements as one likes on a line, even many on a relatively short distance so as to support an especially large or heavy piece of clothing.

The clothes holding elements are used like this: to grip a piece of clothing, the user has simply to place the piece of clothing between the open extensions of two opposing elements about to leave the pulley, with one hand, and then pull the clothes line with the other; after the elements have past around the pulley, they come to the straight portion of the clothesline and the space made between the elements closes itself on the clothing therefore trapping it and so on until all the needded gripping needed is applied. To remove the clothing from the line one has simply to pull the clothes line toward oneself, which goes through the pulley as it moves, and each time a pair of elements comes in contact with the pulley, the two extensions separate from one another thus freeing the piece of clothing which is then free to fall into a bucket placed previously under the pulley. In a sudden downpour of rain, the user has simply to pull back the line as fast has he can and let the clothes fall into the bucket, thus saving time and sparing his or her clothing from being all wet again!

DETAILED DESCRIPTION OF THE DRAWINGS

Figure 1:
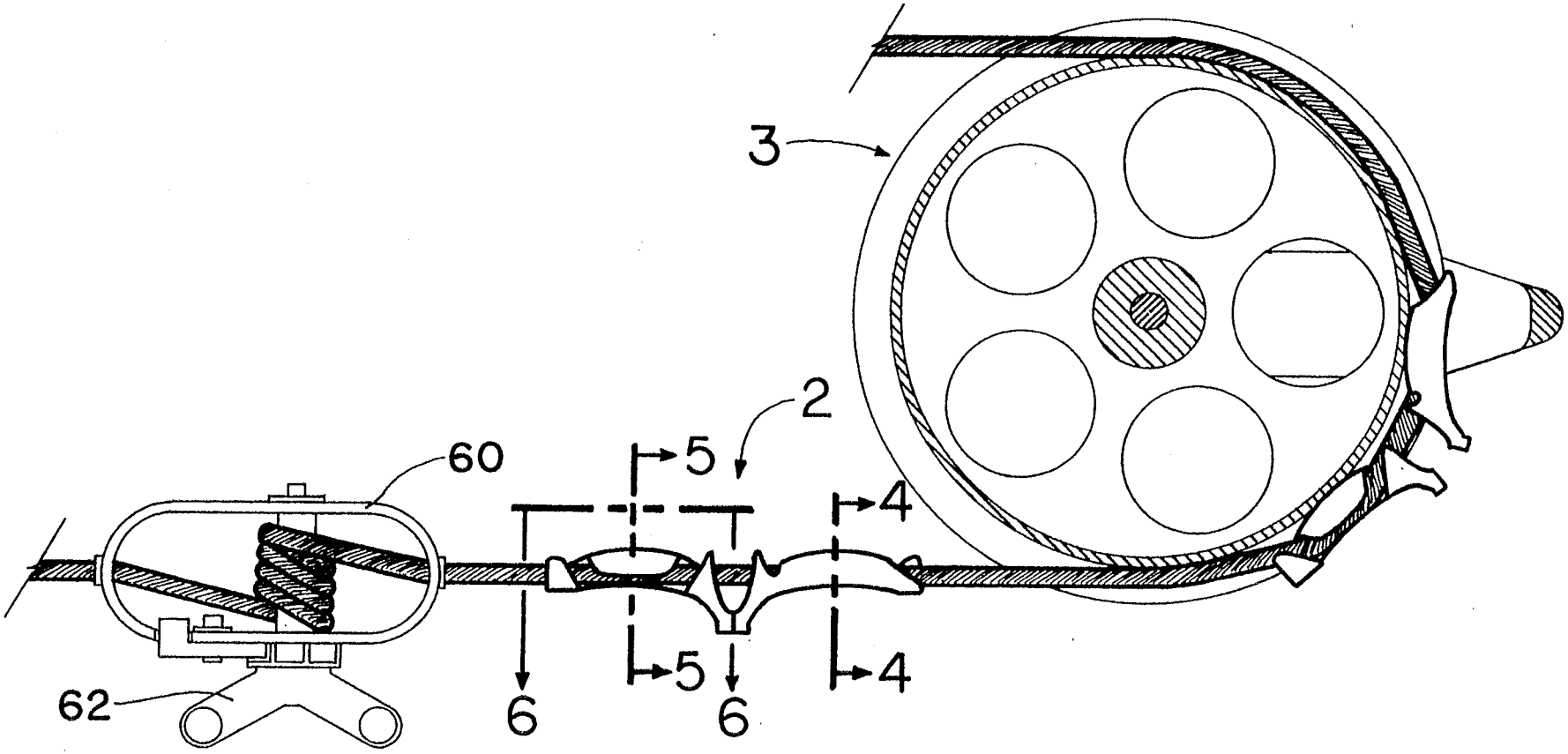
FIG. 1 is a side view of a pair of elements installed on a clothes line, with pulley partially cut.
Figure 2:
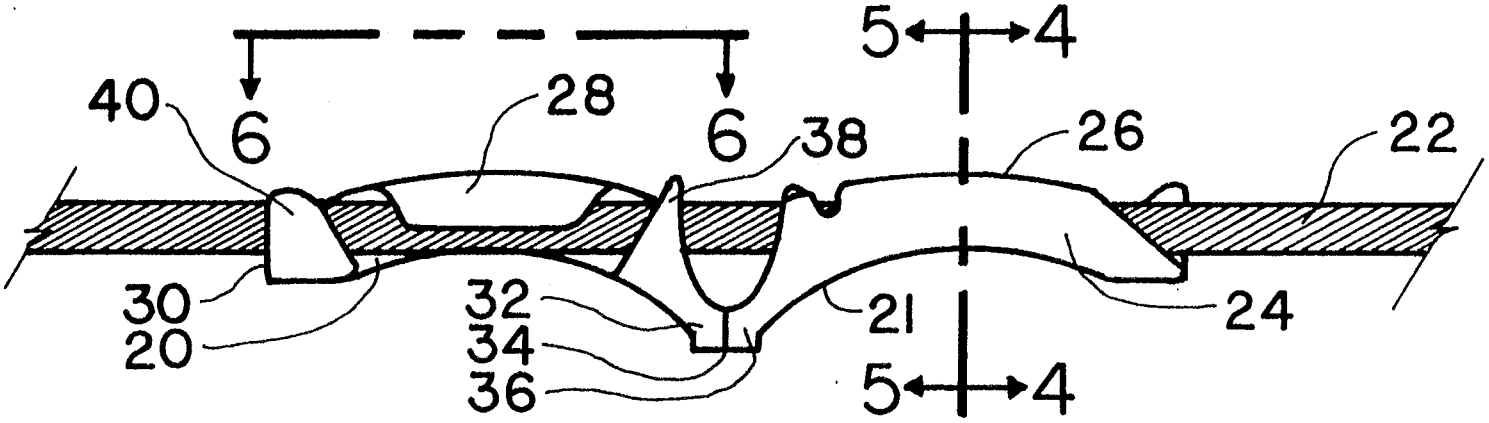
FIG. 2 is an enlarged side view according to arrow 2 of FIG. 1.
Figure 6:
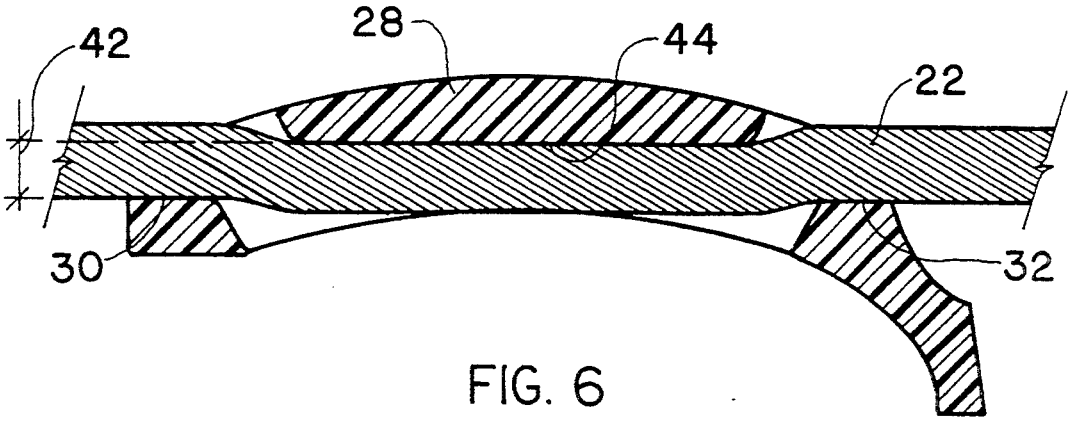
FIG. 6 is a cut view according to line 6—6 of FIG. 1.

By referring to the figures, the components of the clothes holding elements can be identified by like numbers on all figures, where one can see on FIG. 2 a pair of identical elements 20, 21 made of metal or a resilient polymer, facing each other when installed coaxially on a clothes line 22, the elements comprising a side panel 24, a top 26 from which extends a downwardly oriented upper lip 28, a trailing end 30, a gripping end 32. On the gripping end 32 is attached a downwardly oriented extension 36, said extention being fitted with a gripping face 36 and an upwardly oriented retaining lip 38 at the front gripping end and lip 40 extending from the trailing end 30. The space 42—FIG. 6—between the inside surface 44 of the top 28 and the inside surfaces 30 and 32 of the bottom lips 40 and 38 is slightly less than the diametre of the clothes line 22. The volume limited by the inside face 46—FIG. 3—of the side panel 24 and the discontinuous interior surfaces formed by the upper lip 28 and the two retaining lips 40 & 38 at each end of the side panel, is sufficient to allow the passage the clothes line. Thus seen from either end this passage has the appearance of an oval, its greater axis being horizontal.

Figure 3:
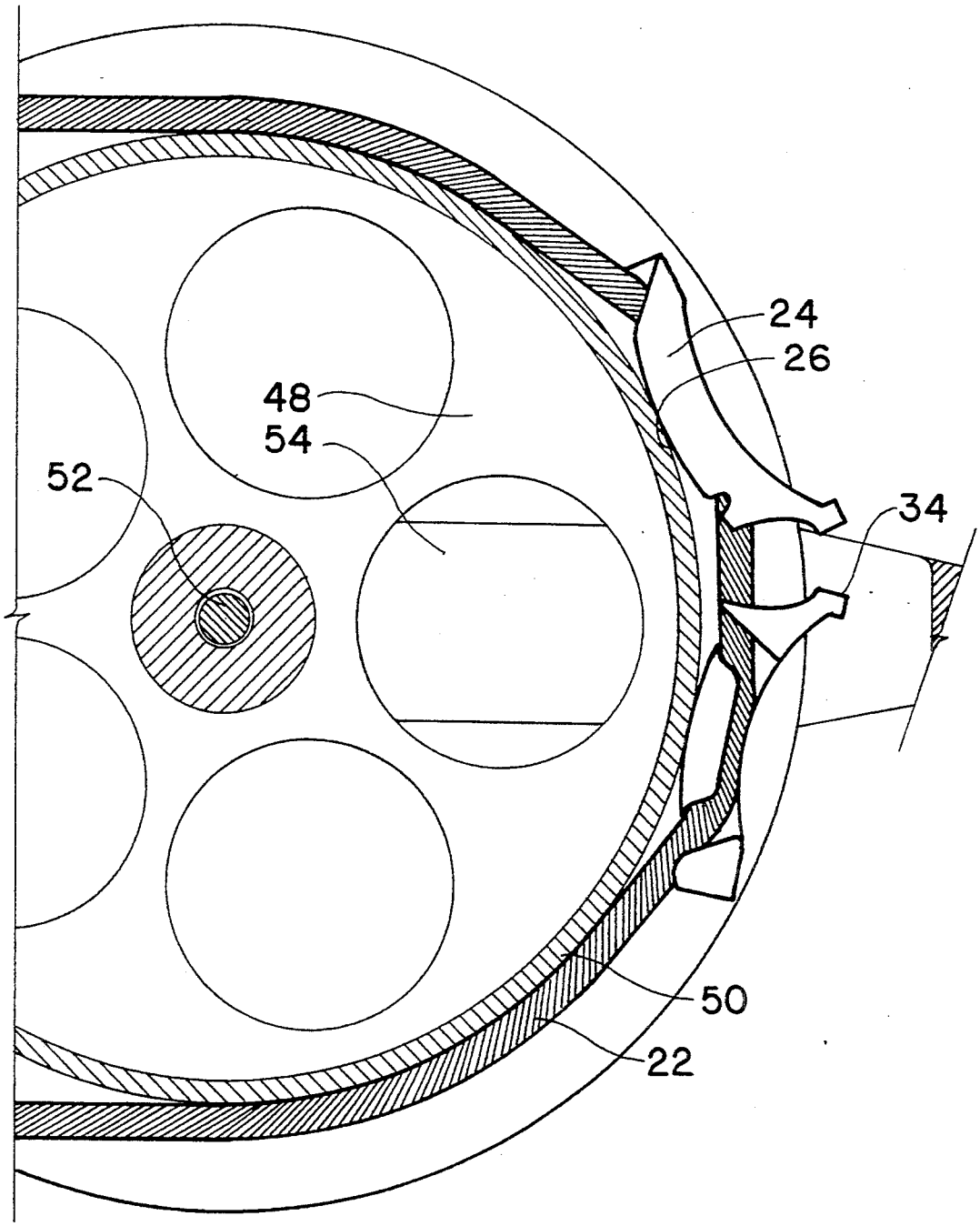
FIG. 3 is a view of the pulley according to arrow 3 of FIG. 1.
Figure 5:
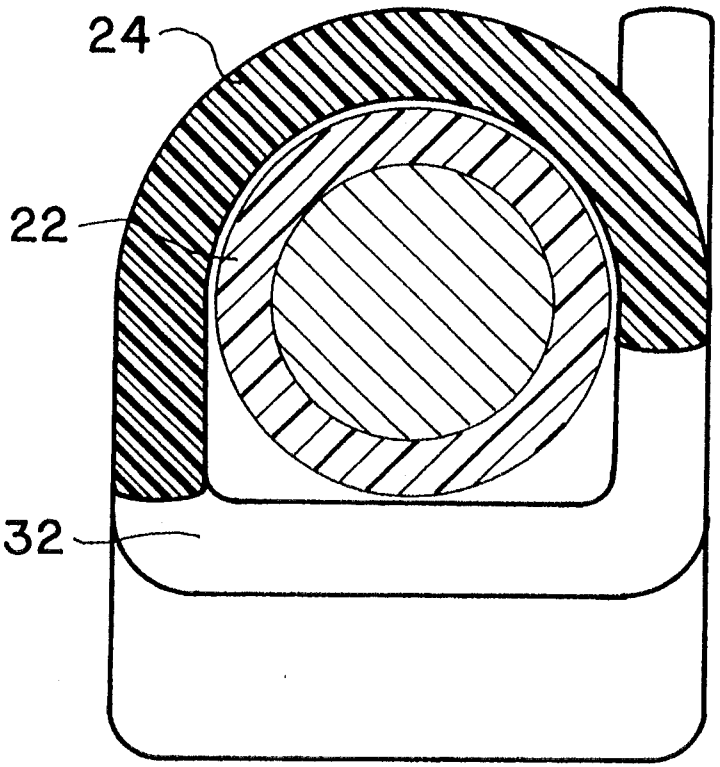
FIG. 5 is an enlarged section according to line 5—5 of FIG. 1.
Figure 4:
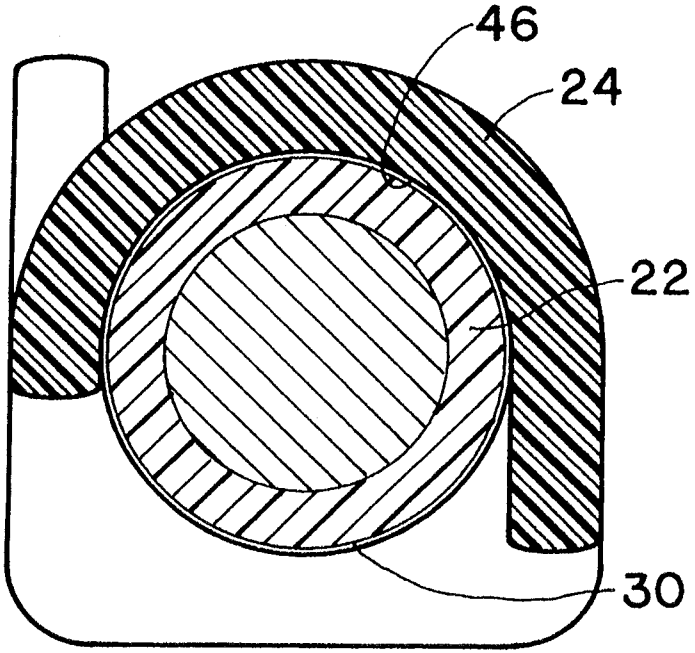
FIG. 4 is a section according to line 4—4 of FIG. 1 enlarged.

On FIG. 3 one can see a standard clothes line pulley 48, the clothes line 22 passing in a groove 50. The pulley turns around a central pivot 52 which is attached to a yoke 54 for hooking onto a post. Also able to pass in the groove is the top 26 of each element. The top part of each element may be made the shape of the Vee in the pulley groove to remain stable within the groove while passing from bottom to top of pulley. It is preferable to use a yoke with an elongated opening in order to leave room to pass the tongue 34. The tongue 34 comprises a beveled face 56—FIG. 7—which meets the corresponding beveled face 57 of the mating twin. An angle T of 6 degrees or more is thus formed which enhances the gripping action.

Figure 7:
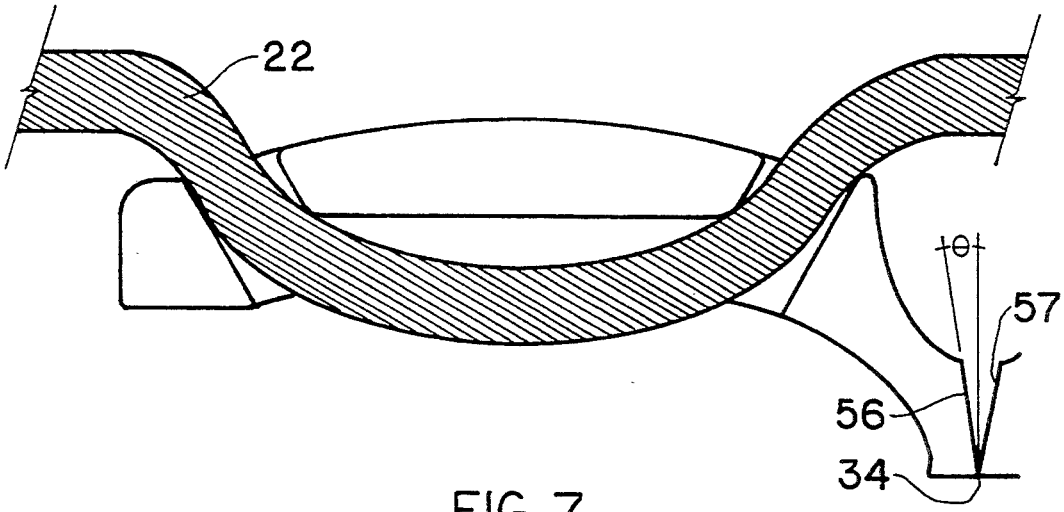
FIG. 7 if a face view during installation on line.

To install the elements on a chord it is preferable to use a tensor 60 such as is found in common clothes lines. Lower the tension by turning handle 62 to slacken the chord to an angle of at least 6 degrees with the horizontal; then it is easy to install the cable between the upper lip and the two lower lips as is shown in FIG. 7.

OTHER EMBODIMENTS

In another embodiment the side panel, top, upper lip, retaining lip configuration could be replaced by a single rigid body, made also of metal or a resilient polymer, with a longitudinal straight groove, the bottom of said groove being roughly semi-circular and having its radial center at the centre axis of the rigid body, said groove also comprising a slight dip at the center to deform the clothes line enough, when the line is pushed in, so that it will not exit the groove unless removed manually. The downward extension/gripping face arrangement would remain the same.

In a further embodiment the groove would be replaced by a longitudinal channel passing through the body. All the elements would then have to be inserted on the clothes line before its installation. To block the elements in place, a wedge like piece would be inserted between the clothes line and the edge of the channel.

Figure 8:
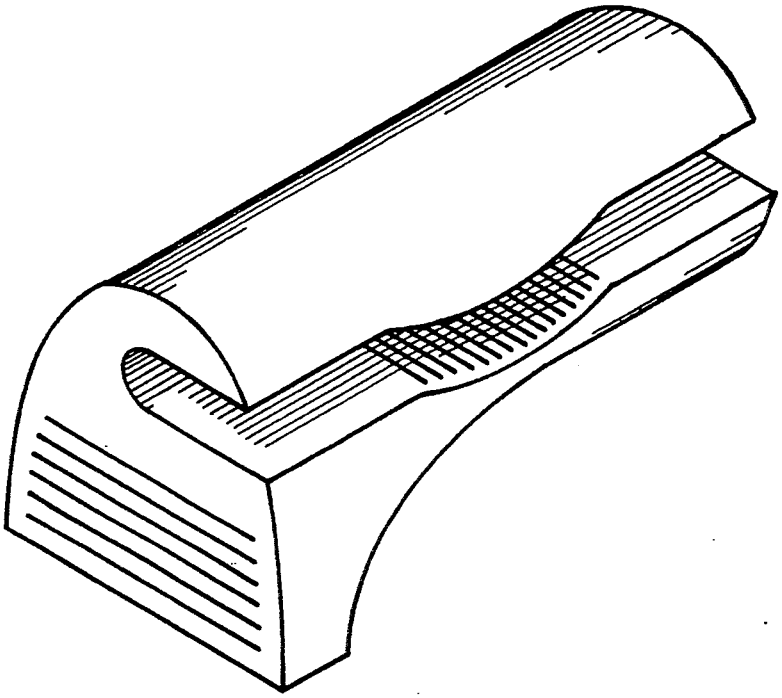
FIG. 8 is a perspective of an alternative.
Figure 9:
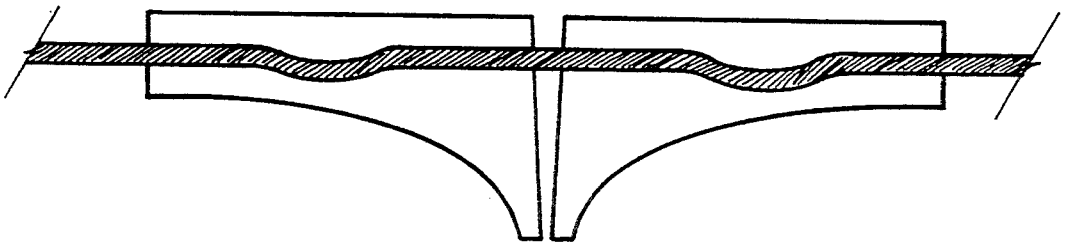
FIG. 9 is a side view of the alternative shown in FIG. 8.

Another embodiment, shown in FIGS. 8 and 9, consists in a check restraining the cable so that the gripping faces meet each other. Other embodiments are also possible and limited only by the scope of the appended claims.

I claim:

1. For use with a conventional clothes line assembly provided with means for slackening said clothes line to an angle of 8 degrees or about, a plurality of pairs of clothes holding elements secured to said line in spaced relationship therealong, the use in opposition of two elements allowing the gripping of clothes, said elements comprising:

means for attaching said elements to said clothes line, a pair of rigid bodies, wherein each body in the pair is identical and used in reversed positions, said body comprising a trailing end, a gripping end and one side joining said trailing end with said gripping end, said gripping end comprising a downwardly projecting extension, the tip of said extension forming an angle relative to an axis perpendicular to the clothes line, so that when two elements face each other the two opposing bodies grip any clothing placed between said two elements.

2. Clothes holding elements as defined in claim 1, said means for attaching comprising a downward curve at the middle of the length of said side, an open space between said downward curve and said trailing and gripping ends permitting passage of said clothes line, said downward curve, acting lengthwise in combination with said gripping and trailing ends causing a non-permanent deformation in said clothes line, thus securing said body to said clothes line.

3. Clothes holding elements as defined in claim 2 wherein said means for attaching comprise:

the combination of said trailing and gripping ends forming between each other a straight horizontal line, said element being aligned horizontally under said clothes line, and a downwardly oriented upper lip mounted on said side of said element, said downwardly oriented upper lip comprising an inside surface projecting perpendicularly with respect to said horizontal straight line up to a position beyond said horizontal straight line, said inside surface defining a through channel through which the clothes line is inserted, said rigid body being secured to the line by a wedging element formed by said inside surface and driven downwardly against and beyond said horizontal straight line therefore blocking said trailing and gripping ends against said clothes line thus preventing movement therefrom.

4. Clothes holding elements as defined in claim 1 wherein said means for attaching are for use with a clothes line with means for slackening, said means for attaching comprising:

a channel being of height inferior to the diameter of said clothes line, an upwardly curved "U"-shaped opening facing said side, one end of said opening finishing at said trailing end and the other end finishing at said gripping end.

5. For use with a conventional clothes line assembly provided with a set of pulleys, said clothes line comprising means of slackening said clothes line to an angle at least equal to six (6) degrees, a plurality of pairs of clothes holding elements secured to said line in spaced relationship therealong, the use in opposition of two elements allowing the gripping of clothes, said elements comprising:

a pair of elongated bodies each made of a rigid material and comprising means for attaching said pair of elongated bodies to the clothes line, each body generally oriented longitudinally with respect to said line and comprising a trailing end and a gripping end, said gripping end comprising a gripping surface projecting laterally of said line on an extention, said trailing end oriented along said clothes line and the gripping ends of the two bodies facing each other, the tip of which forming an angle relatively perpendicular to the clothes line, said angle varying from 90 to 100 degrees with respect to the horizontal axis of the body, so that when the two elongated bodies are coaxial the two extentions face each other, the two opposing gripping faces grip the clothing, the same arrangement allowing ungripping when the two bodies start turning around said clothes line pulley and make an angle of 16 to 20 degrees in regards to a horizontal line parallel to the clothes line, thus becoming no longer coaxial and thus said gripping faces separating from one another, releasing said clothes inserted therebetween, the reverse operation, passage from a non-coaxial to a coaxial position, causing the gripping of any piece of clothes inserted therebetween.

* * * * *